US008995876B2

(12) United States Patent
Okabe

(10) Patent No.: US 8,995,876 B2
(45) Date of Patent: Mar. 31, 2015

(54) DRUM UNIT, DEVELOPMENT CARTRIDGE DETACHABLY ATTACHABLE TO THE DRUM UNIT, AND IMAGE FORMING APPARATUS HAVING THE DRUM UNIT AND THE DEVELOPMENT CARTRIDGE

(75) Inventor: Yasushi Okabe, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 951 days.

(21) Appl. No.: 13/070,032

(22) Filed: Mar. 23, 2011

(65) Prior Publication Data

US 2011/0293325 A1 Dec. 1, 2011

(30) Foreign Application Priority Data

May 31, 2010 (JP) ..... 2010-124277

(51) Int. Cl.
*G03G 15/08* (2006.01)
*G03G 21/18* (2006.01)
*G03G 15/01* (2006.01)

(52) U.S. Cl.
CPC ..... *G03G 21/1821* (2013.01); *G03G 15/0178* (2013.01)
USPC ..... 399/113; 399/119

(58) Field of Classification Search
CPC ..... G03G 21/1676; G03G 2221/1684; G03G 21/1647; G03G 21/1821; G03G 15/0896; G03G 2221/163; G03G 21/1853; G03G 21/1842
USPC ..... 399/113, 119
See application file for complete search history.

(56) References Cited

U.S. PATENT DOCUMENTS

| | | | |
|---|---|---|---|
| 6,041,203 | A | 3/2000 | Suzuki et al. |
| 6,330,410 | B1 | 12/2001 | Okabe et al. |
| 2003/0049046 | A1 | 3/2003 | Okabe |
| 2003/0053819 | A1 | 3/2003 | Nomura et al. |
| 2006/0029418 | A1 | 2/2006 | Ishii et al. |

(Continued)

FOREIGN PATENT DOCUMENTS

| | | | |
|---|---|---|---|
| JP | 2000-250378 | A | 9/2000 |
| JP | 2002-174938 | A | 6/2002 |

(Continued)

OTHER PUBLICATIONS

Feb. 4, 2014 Office Action issued in Japanese Patent Application No. 2010-124277.

*Primary Examiner* — Clayton E Laballe
*Assistant Examiner* — Ruth Labombard
(74) *Attorney, Agent, or Firm* — Banner & Witcoff, Ltd.

(57) ABSTRACT

A drum unit is provided, which includes a frame configured such that a development cartridge including a pressed portion is detachably attached thereto, and a pressing member. The development cartridge is movable between a pressed state where the pressed portion is pressed by the pressing member when attached to the frame and a released state where the pressed portion is released from pressing of the pressing member when the development cartridge is attached to the frame. The pressing member includes a pressing section that contacts and presses the pressed portion when the development cartridge is in the pressed state, and a restriction section configured to, when the development cartridge is in the pressing state, restrict movement of the pressed portion in a released direction, in which the pressed portion moves when the development cartridge moves from the pressing state to the released state.

24 Claims, 14 Drawing Sheets

(56) References Cited

U.S. PATENT DOCUMENTS

| | | | | |
|---|---|---|---|---|
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0133850 | A1* | 6/2006 | Nishimura | 399/113 |
| 2009/0220273 | A1 | 9/2009 | Tomatsu | |
| 2010/0166453 | A1 | 7/2010 | Okabe | |
| 2010/0166457 | A1 | 7/2010 | Hashimoto | |
| 2011/0052254 | A1 | 3/2011 | Hashimoto | |

FOREIGN PATENT DOCUMENTS

| | | | |
|---|---|---|---|
| JP | 2003-084647 | A | 3/2003 |
| JP | 2003-107838 | A | 4/2003 |
| JP | 2006-072284 | A | 3/2006 |
| JP | 2006-106020 | A | 4/2006 |
| JP | 2009-210631 | A | 9/2009 |
| JP | 2010-156790 | A | 7/2010 |
| JP | 2010-156791 | A | 7/2010 |
| JP | 2011-070154 | A | 4/2011 |

* cited by examiner

DRUM UNIT, DEVELOPMENT CARTRIDGE DETACHABLY ATTACHABLE TO THE DRUM UNIT, AND IMAGE FORMING APPARATUS HAVING THE DRUM UNIT AND THE DEVELOPMENT CARTRIDGE

CROSS-REFERENCE TO RELATED APPLICATION

This application claims priority under 35 U.S.C. §119 from Japanese Patent Application No. 2010-124277 filed on May 31, 2010. The entire subject matter of the application is incorporated herein by reference.

BACKGROUND

1. Technical Field

The following description relates to one or more process units, each of which includes a drum unit and a development cartridge, for an image forming apparatus such as a laser printer.

2. Related Art

In an example of an image forming apparatus such as a laser printer, a drum cartridge holding a photoconductive drum is detachably attached into a main body of the apparatus. Further, the drum cartridge includes a development cartridge attached thereto that supports a development roller. The drum cartridge having the development cartridge attached thereto constitutes a process cartridge.

In a state where the development cartridge is attached to the drum cartridge, the development roller contacts the photoconductive drum. In order to make the development roller contact the photoconductive drum under a predetermined pressing force, the drum cartridge includes a pressing member by which the development cartridge is pressed against the photoconductive drum. Specifically, the pressing member is urged by a compression spring. The development cartridge includes a development-side boss. When the development cartridge is attached to the drum cartridge, the pressing member contacts the development-side boss, and the pressing member is pressed against the development-side boss by an urging force of the compression spring so as to establish a pressure-contact between the development roller and the photoconductive drum.

SUMMARY

A user may attach the process cartridge into the main body of the image forming apparatus swiftly with a great force. In the main body, a positioning member is provided to position the process cartridge. When the process cartridge is attached into the main body, a drum-side boss provided to the drum cartridge engages with the positioning member such that the process cartridge is positioned. Therefore, when the process cartridge is attached into the main body swiftly with a great force, the development cartridge might be detached from the drum cartridge by an impact at the time when the drum-side boss engages with the positioning member.

In order to prevent the development cartridge from being improperly detached from the drum cartridge, the drum cartridge is provided with a lock lever. When the development cartridge is attached to the drum cartridge, the lock lever comes into contact with the development-side boss from an upstream side in the attaching direction. Thereby, the development cartridge is restrained from moving toward the upstream side in the attaching direction, and thus the development cartridge is prevented from being improperly detached from the drum cartridge.

However, the configuration of the drum cartridge provided with the lock lever causes problems such as a complicated configuration and a larger number of parts of the process cartridge (the drum cartridge).

Aspects of the present invention are advantageous to provide one or more improved techniques for a process unit including a drum unit and a development cartridge, which techniques make it possible to prevent the development cartridge from being improperly detached from a frame of the drum unit, even with a simple configuration of the process unit.

According to aspects of the present invention, a drum unit is provided, which includes a frame configured such that a development cartridge is detachably attached thereto, wherein the development cartridge includes a pressed portion and a developer holding body configured to hold and carry thereon development agent, a photoconductive body held by the frame, the photoconductive body having a surface supplied with the development agent from the developer holding body, and a pressing member provided to the frame. The frame is configured such that the development cartridge is movable relative to the frame between a pressed state where the pressed portion is pressed by the pressing member when the development cartridge is attached to the frame and a released state where the pressed portion is released from pressing of the pressing member when the development cartridge is attached to the frame. The pressing member includes a pressing section configured to contact and press the pressed portion when the development cartridge is in the pressed state, and a restriction section that is disposed in a different position from a position of the pressing section and configured to restrict movement of the pressed portion in a released direction when the development cartridge is in the pressing state, the released direction being a direction in which the pressed portion moves when the development cartridge moves from the pressing state to the released state.

According to aspects of the present invention, further provided is an image forming apparatus, which includes a main body casing, a drum unit attached into the main body casing to be movable between a first position where the process unit is inside the main body casing and a second position where the process unit is outside the main body casing, the drum unit including a frame, a photoconductive body held by the frame, and a pressing member provided to the frame, and a development cartridge detachably attached to the frame of the drum unit, the development cartridge including a pressed portion, and a developer holding body configured to hold and carry thereon development agent to be supplied to a surface of the photoconductive body. The development cartridge is movable between a pressed state where the pressed portion is pressed by the pressing member when the development cartridge is attached to the frame and a released state where the pressed portion is released from pressing of the pressing member when the development cartridge is attached to the frame. The pressing member includes a pressing section configured to contact and press the pressed portion when the development cartridge is in the pressed state, and a restriction section that is disposed in a different position from a position of the pressing section and configured to restrict movement of the pressed portion in a released direction when the development cartridge is in the pressing state, the released direction being a direction in which the pressed portion moves when the development cartridge moves from the pressing state to the released state.

According to aspects of the present invention, further provided is a development cartridge, which includes a pressed portion, and a developer holding body configured to hold and carry thereon development agent. The development cartridge is detachably attachable to a frame of a drum unit. The drum unit includes a photoconductive body held by the frame, the photoconductive body having a surface supplied with development agent from the developer holding body, and a pressing member provided to the frame. The development cartridge is movable relative to the frame between a pressed state where the pressed portion is pressed by the pressing member when the development cartridge is attached to the frame and a released state where the pressed portion is released from pressing of the pressing member when the development cartridge is attached to the frame. The pressing member includes a pressing section configured to contact and press the pressed portion when the development cartridge is in the pressed state, and a restriction section that is disposed in a different position from a position of the pressing section and configured to restrict movement of the pressed portion in a released direction when the development cartridge is in the pressing state, the released direction being a direction in which the pressed portion moves when the development cartridge moves from the pressing state to the released state. The pressed portion includes a first pressed section configured to be pressed by the pressing section, and a second pressed section configured to, after contacting the restriction section, be pressed by the restriction section.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

1. Configuration of Color Printer

Figure 1:
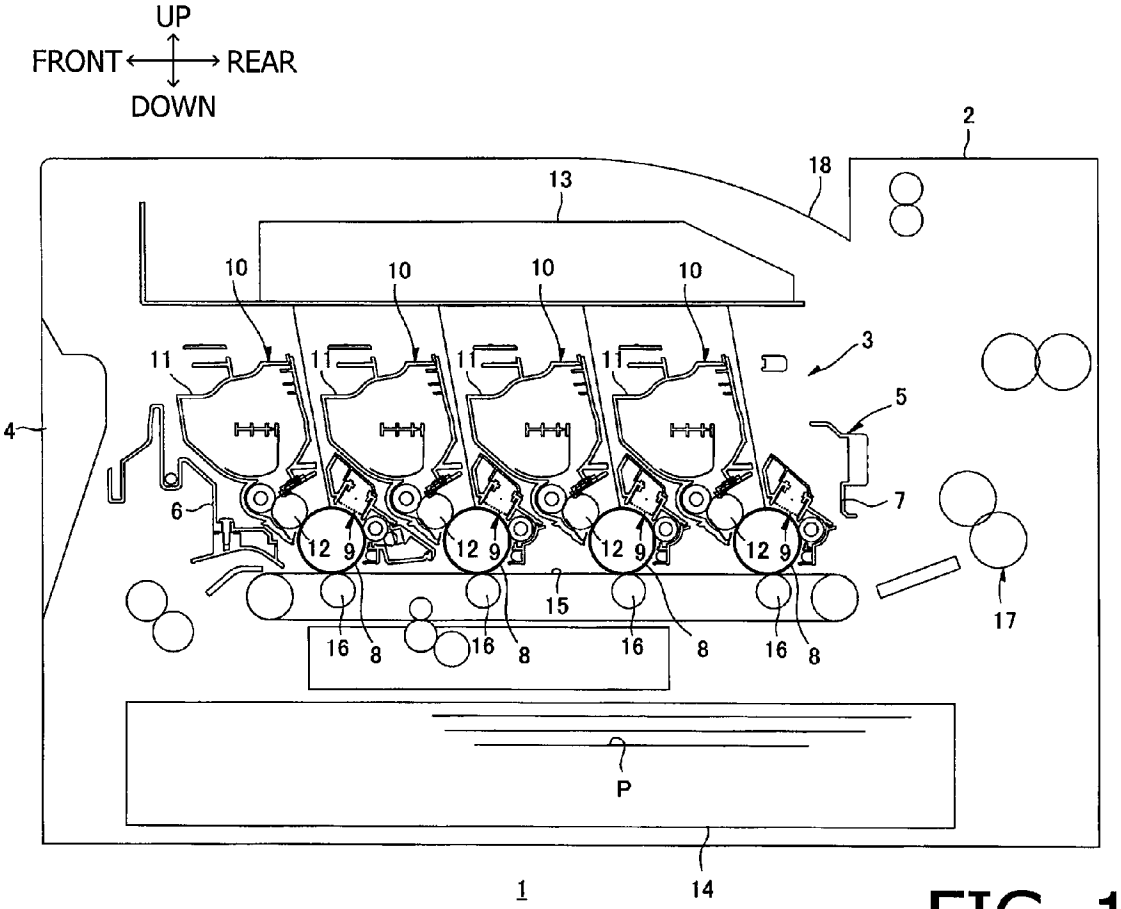
FIG. 1 is a cross-sectional side view schematically showing a configuration of a color printer in an embodiment according to one or more aspects of the present invention.

As shown in FIG. 1, a color printer 1 is a tandem-type color printer. The color printer 1 includes a main body casing 2. Further, a drawer unit 3 is attached into the main body casing 2. A front cover 4 is provided to a front face of the main body casing in an openable and closable manner. In a state where the front cover 4 is opened, the drawer unit 3 is movable horizontally between a housed position where the drawer unit 3 is inside the main body casing 2 (see FIG. 1) and a pulled position where the drawer unit 3 is outside the main body casing 2 (not shown).

It is noted that in the following description, a side where the front cover 4 is disposed will be defined as a front side of the color printer 1 (see FIG. 1). Additionally, an up-to-down direction and a left-to-right direction for the color printer 1 will be as defined when the color printer 1 is viewed from the front side thereof. Further, each direction for the drawer unit 3 will, unless specified otherwise, be defined in conformity to the directions for the color printer 1 in a state where the drawer unit 3 is attached into the color printer 1.

The drawer unit 3 includes a drawer frame 5 that has a substantially rectangle shape in a top view. The drawer frame 5 includes two side plates that face each other across a predetermined distance in the left-to-right direction, a front beam 6 provided to bridge respective front ends of the two side plates, and a rear beam 7 provided to bridge respective rear ends of the two side plates.

In the drawer frame 5, four photoconductive drums 8 are supported to be rotatable around respective rotational axes extending in the left-to-right direction. The four photoconductive drums 8 are provided for four colors, i.e., black, yellow, magenta, and cyan, respectively, and arranged parallel to each other at intervals of a constant distance along the front-to-rear direction in the order of black, yellow, magenta, and cyan from the front side.

Further, in the drawer frame 5, four electrification devices 9 are held between the two side plates. The four electrification devices 9 are provided to correspond to the four photoconductive drums 8, respectively. Each electrification device 9 is disposed in a position that is behind and higher than a corresponding one of the photoconductive drums 8. For instance, each electrification device 9 is a scorotron type charger having a wire and a grid.

The drawer unit 3 includes four development cartridges 10 configured to be detachably attached to the drawer frame 5. The four development cartridges 10 are provided to correspond to the four photoconductive drums 8, respectively. Each development cartridge 10 is attached from an upper side of the drawer frame 5 in a state where the drawer unit 3 is pulled out up to the pulled position, and disposed in an upper front position relative to a corresponding one of the photoconductive drums 8.

Each development cartridge 10 includes a development housing 11 and a development roller 12 supported by the development housing 11. The development roller 12 is provided rotatably around a rotational axis extending in the left-to-right direction, and a part of a circumferential surface of the development roller 12 is exposed out of the development housing 11. When the development cartridge 10 is attached to the drawer frame 5, the circumferential surface of the development roller 12 contacts an upper front side of a circumferential surface of the photoconductive drum 8.

In the main body casing 2, an exposure device 13 is disposed above the drawer unit 2 and configured to emit four laser beams that correspond to the four colors, respectively.

In response to the rotation of the photoconductive drum 8, the circumferential surface of the photoconductive drum 8 is selectively exposed to the laser beam from the exposure device 13 after being evenly charged by the electrification device 9 discharging. By the exposure, charges are removed selectively from the circumferential surface of the photoconductive drum 8 such that an electrostatic latent image is formed on the circumferential surface of the photoconductive drum 8. When facing the development roller 12, the electrostatic latent image is supplied with toner from the development roller 12. Thereby, a toner image is held and carried on the circumferential surface of the photoconductive drum 8.

It is noted that instead of the exposure device 13, four LED arrays may be provided to correspond to the photoconductive drums 8, respectively.

At a bottom of the main body casing 2, a feed cassette 14 is disposed that accommodates one or more sheets P. Each sheet P placed on the feed cassette 14 is fed onto a conveying belt 15 by various rollers. The conveying belt 15 is disposed in a position lower than the four photoconductive drums 8, such that an upper-side surface thereof faces the four photoconductive drums 8. Transfer rollers 16 are disposed in positions to face the photoconductive drums 8 across the upper-side of the conveying belt 15, respectively. The sheet P fed on the conveying belt 15 passes through between the conveying belt 15 and each photoconductive drum 8, while being conveyed on the conveying belt 15 traveling. A toner image formed on each photoconductive drum 8 is transferred onto the sheet P when facing the sheet P between the photoconductive drum 8 and a corresponding one of the transfer rollers 16.

A fixing unit 17 is disposed in a downstream position relative to the conveying belt 15 in a feeding direction for feeding the sheet P. The sheet P with the toner image transferred thereon is fed to the fixing unit 17. The fixing unit 17 is configured to fix the toner image onto the sheet P by heating and pressing the sheet P. The sheet P with the toner image fixed thereon is ejected by various rollers onto a catch tray 18 which is formed on an upper surface of the main body casing 2.

2. Drawer Unit (1) Cartridge Guide

A shown in FIGS. 2, and 3A to 3G, cartridge guides 21 are formed on an inner surface of each side plate (not shown) of the drawer frame 5 of the drawer unit 3. Each cartridge guide 21 is configured to guide a corresponding one of the four development cartridges 10 when the development cartridge 10 is attached to or detached from the drawer frame 5. More specifically, on the inner surface of each side plate, projection rails (rib-shaped walls) 22 are formed that protrude toward the inside of the drawer frame 5. Each projection rail 22 is formed substantially in a shape of the character "U" that is open upward. Each cartridge guide 21 is formed with an inside section partitioned by the projection rail 22.

A lower end portion of the projection rail 22 extends along a straight line connecting a rotational center of the photoconductive drum 8 and a rotational center of the development roller 12 in the state where the development cartridge 10 is attached to the drawer frame 5. Then, the lower end portion of the projection rail 22 bends toward an upper rear side at an angle of 90 degrees at the lowest end, further bends toward au upper front side at an angle of 90 degrees point, and again extends along the aforementioned straight line. Namely, the lower end portion of the projection rail 22 is formed in a shape of an angular "C." Further, a lower end section of the cartridge guide 21, which is formed with the C-shaped portion, extends to be parallel to the straight line connecting the rotational center of the photoconductive drum 8 and the rotational center of the development roller 12. In addition, a width of the lower end section of the cartridge guide 21 is as long as an outer diameter of a below-mentioned shaft cover 45.

(2) Pressing Member

Further, each side plate (not shown) of the drawer frame 5 is provided with four pressing members 31 each of which is configured to press a corresponding one of the four development cartridges 10. Each pressing member 31 is formed substantially in a fan shape with a circumferential surface portion being partially removed from a fan with a central angle of 60 degrees when viewed in the left-to-right direction. More specifically, the pressing member 31 has a shape formed with a half-arc surface 32, a crank-shaped surface 33, a linear surface 34, and a protruding surface 35. The half-arc surface 32 is formed in a half-arc shape when viewed in the left-to-right direction. The crank-shaped surface 33 is formed in a crank shape extending from one end of the half-arc surface 33 when viewed in the left-to-right direction. The linear surface 34 is formed in a linear shape extending from the other end of the half-arc surface 33 when viewed in the left-to-right direction. The protruding surface 35 is continuous with the crank-shaped surface 33 and the linear surface 34 and protrudes to be farther from the half-arc surface 32.

At each side of each development cartridge 10 in the left-to-right direction, a shaft 36 extending in the left-to-right direction is disposed in such a position as to face an upper front end of the development cartridge 10. Each shaft 36 is un-rotatably held by the side plates of the drawer frame 5.

Then, a distal end of the shaft 36 is inserted into a portion that is a center of the half-arc surface 32 of the pressing member 31, so as to be rotatable relative to the pressing member 31. Thereby, the pressing member 31 is supported by the shaft 36 to be swingable (rotatable) around the shaft 36. As depicted in FIG. 3G, the pressing member 31 is provided such that the crank-shaped surface 33 thereof extends in non-contact with the development cartridge 10 so as to be inclined slightly rearward relative to the vertical direction.

Figure 2:
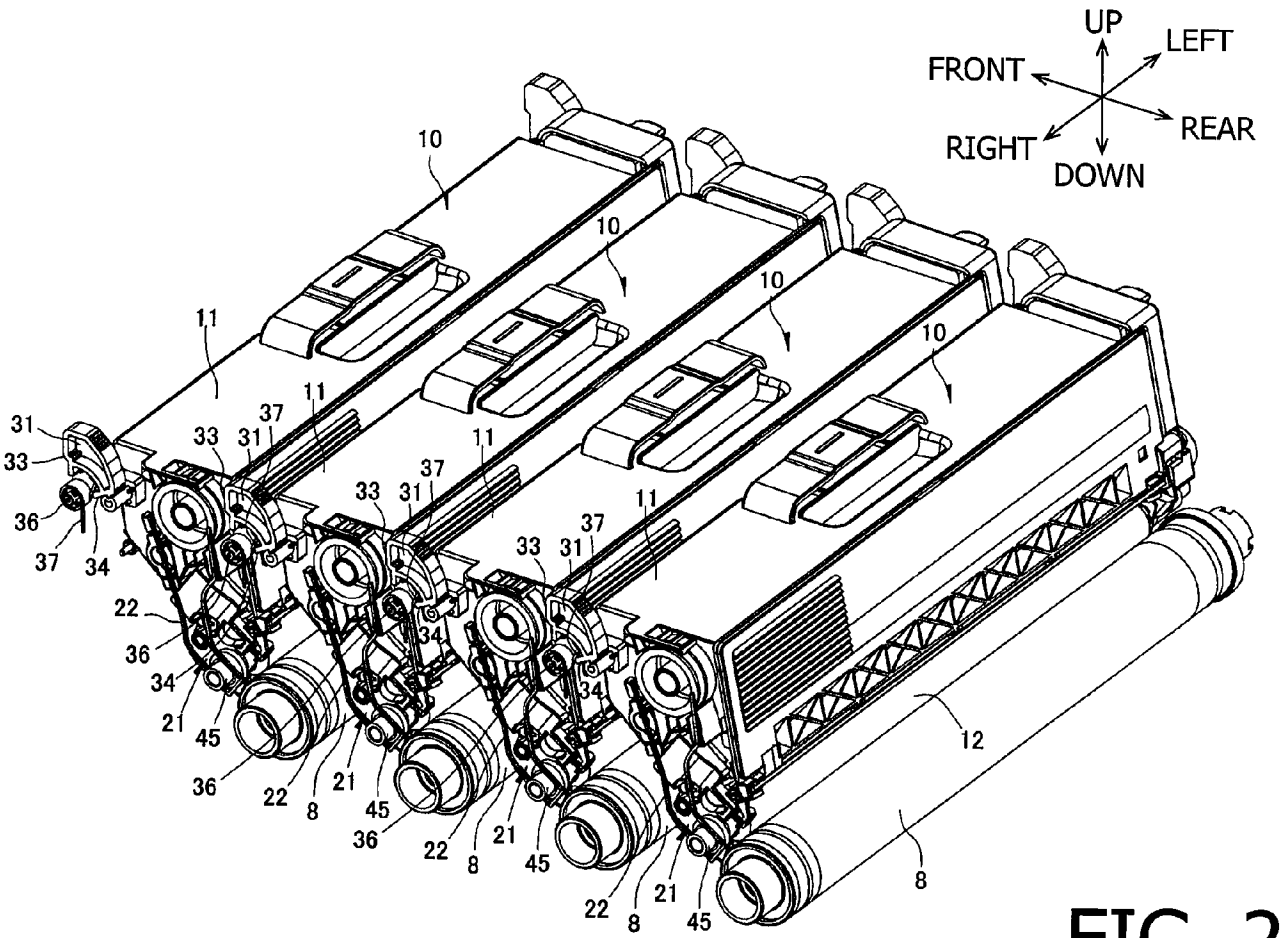
FIG. 2 is a perspective view showing a drawer unit for the color printer in the embodiment according to one or more aspects of the present invention.

Further, as illustrated in FIG. 2, a linear spring 37 is wound around the shaft 36. One end of the linear spring 37 extends downward from the shaft 36 and is fixed to the side plate of the drawer frame 5. The other end of the linear spring 37 is fixed to the pressing member 31. The pressing member 31 is urged clockwise by the linear spring 37 when viewed from the right side.

When viewed in the left-to-right direction, the linear surface 34 of the pressing member 31 bends at an angle of 90 degrees, slightly extends toward a lower rear side, further bends, and then extends toward the protruding surface 35. Thereby, at an end of the linear surface 34 that is closer to the protruding surface 35, a restriction section 38 is formed substantially in a right-triangle shape when viewed in the left-to-right direction. A section of the linear surface 34 other than a section where the restriction section 38 is formed is defined as a pressing section 39 for pressing a below-mentioned a pressed boss 41.

3. Development Cartridge

Figure 4:
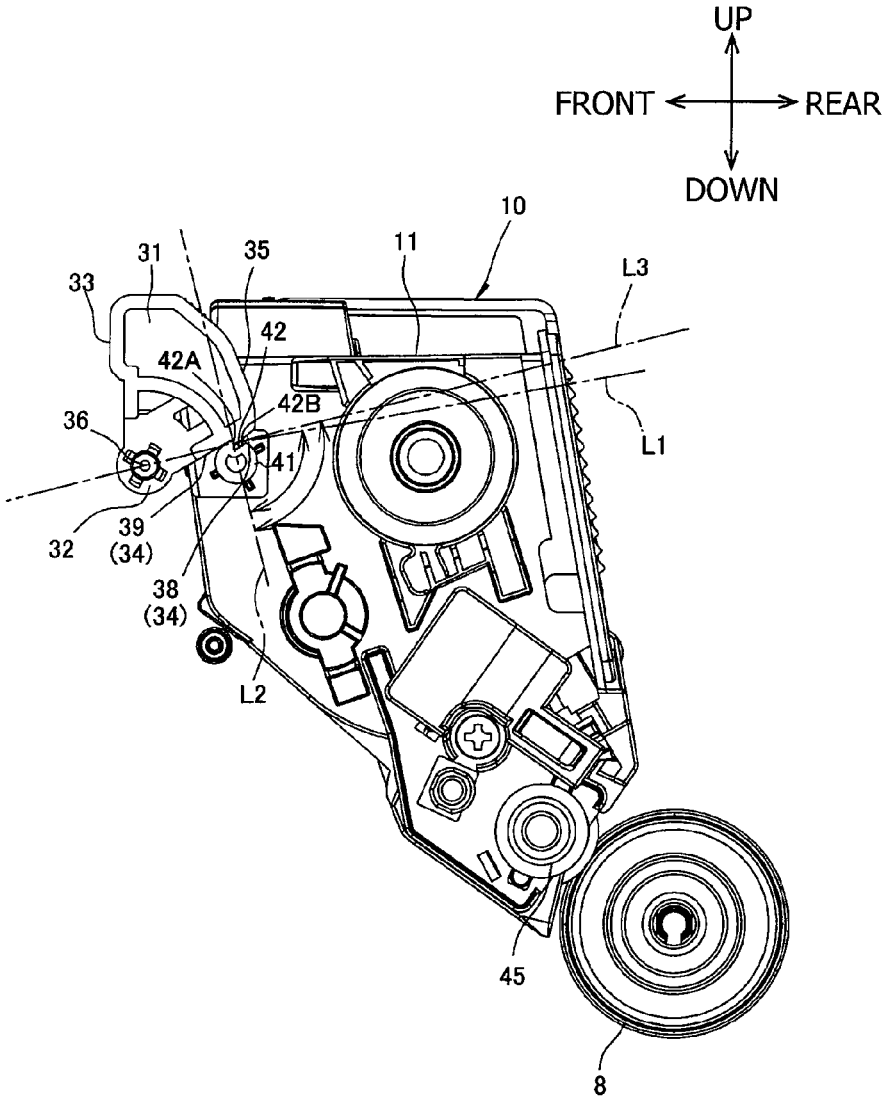
FIG. 4 is a right-side view illustrating in an enlarged manner a part of the drawer unit shown in FIG. 3D in a state where the pressed boss contacts the restriction section in the embodiment according to one or more aspects of the present invention.

The development housing 11 of the development cartridge 10 is formed substantially in a triangle shape with a lower portion thereof being narrower downward when viewed in the left-to-right direction. At an upper front end of each side face of the development housing 11, a pressed boss 41 is disposed that protrudes outward. The pressed boss 41 is formed substantially in a cylindrical shape. A portion of the pressed boss 41 that faces the restriction section 38 of the pressing member 31 is formed with an L-shaped notch 42 recessed toward a lower rear side when viewed in the left-to-right direction. Thereby, as shown in FIG. 4, the pressed boss 41 includes, in the notch 42, a first flat surface 42A inclined slightly forward relative to the up-to-down direction (the vertical direction) and a second flat surface 42B that is perpendicular to the first flat surface 42A and inclined slightly toward an upper rear side relative to the front-to-rear direction (the horizontal direction) (for example, see FIG. 4).

The development roller 12 is held by a lower end of the development housing 11. Specifically, the development roller 12 includes a roller main body 43 formed in a cylindrical shape around as a central axis line extending in the left-to-right direction, and a development roller shaft 44 inserted into the roller main body 43 along the central axis line. Both ends of the development roller shaft 44 in the left-to-right direction protrude from both end faces of the roller main body 43 in the left-to-right direction, and penetrate both side faces of the development housing 11, respectively, so as to be rotatably supported by the development housing 11. A cylindrical shaft cover 45 is attached to a portion of the development roller shaft 44 that protrudes from the development housing 11.

4. Attaching and Detaching of Development Cartridge

When the development cartridge 10 is attached to the drawer frame 5, the drawer frame 5 (the drawer unit 3) is pulled to the pulled position outside the main body casing 2. Then, the development cartridge 10 is placed above the drawer frame 5, and the development cartridge 10 is moved toward the photoconductive drum 8 with the development roller 12 being directed downward. In the middle of this movement, the shaft cover 45 on each end of the development roller shaft 44 is inserted into the cartridge guide 21 from above. After that, in response to the movement of the development cartridge 10, the shaft cover 45 is guided by the cartridge guide 21 such that the development roller 12 moves in such a direction as to approach the photoconductive drum 8. Thereafter, when the shaft cover 45 reaches the lower end section of the cartridge guide 21, a further movement of the development cartridge toward the photoconductive drum 8 is restricted.

Figure 3A:
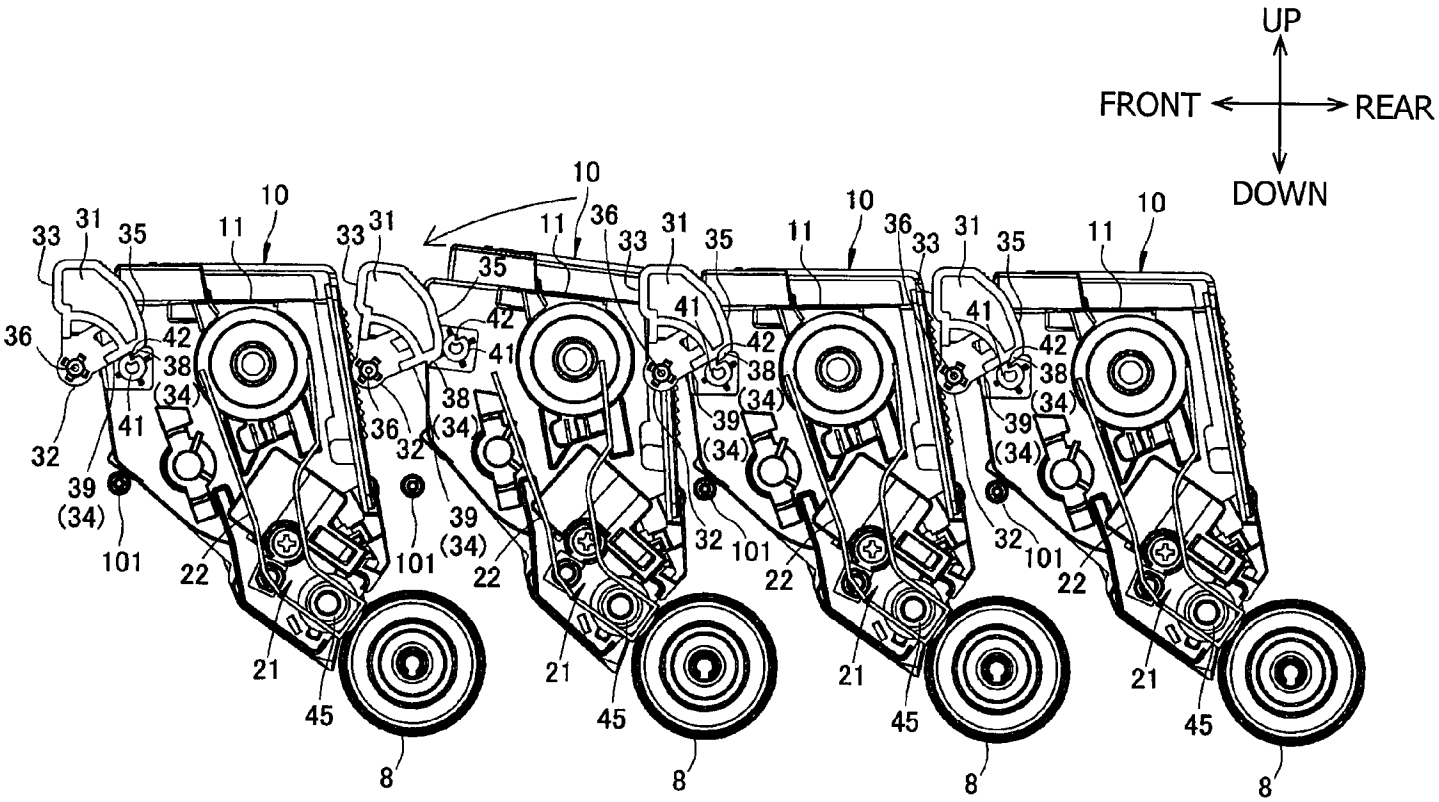
FIG. 3A is a right-side view of the drawer unit (in which a drawer frame is not shown) before a development cartridge is attached thereto in the embodiment according to one or more aspects of the present invention.

In this state, as shown in FIG. 3A, the pressed boss 41 of the development cartridge 10 contacts the lower end of the protruding surface 35 of the pressing member 31.

Figure 3B:
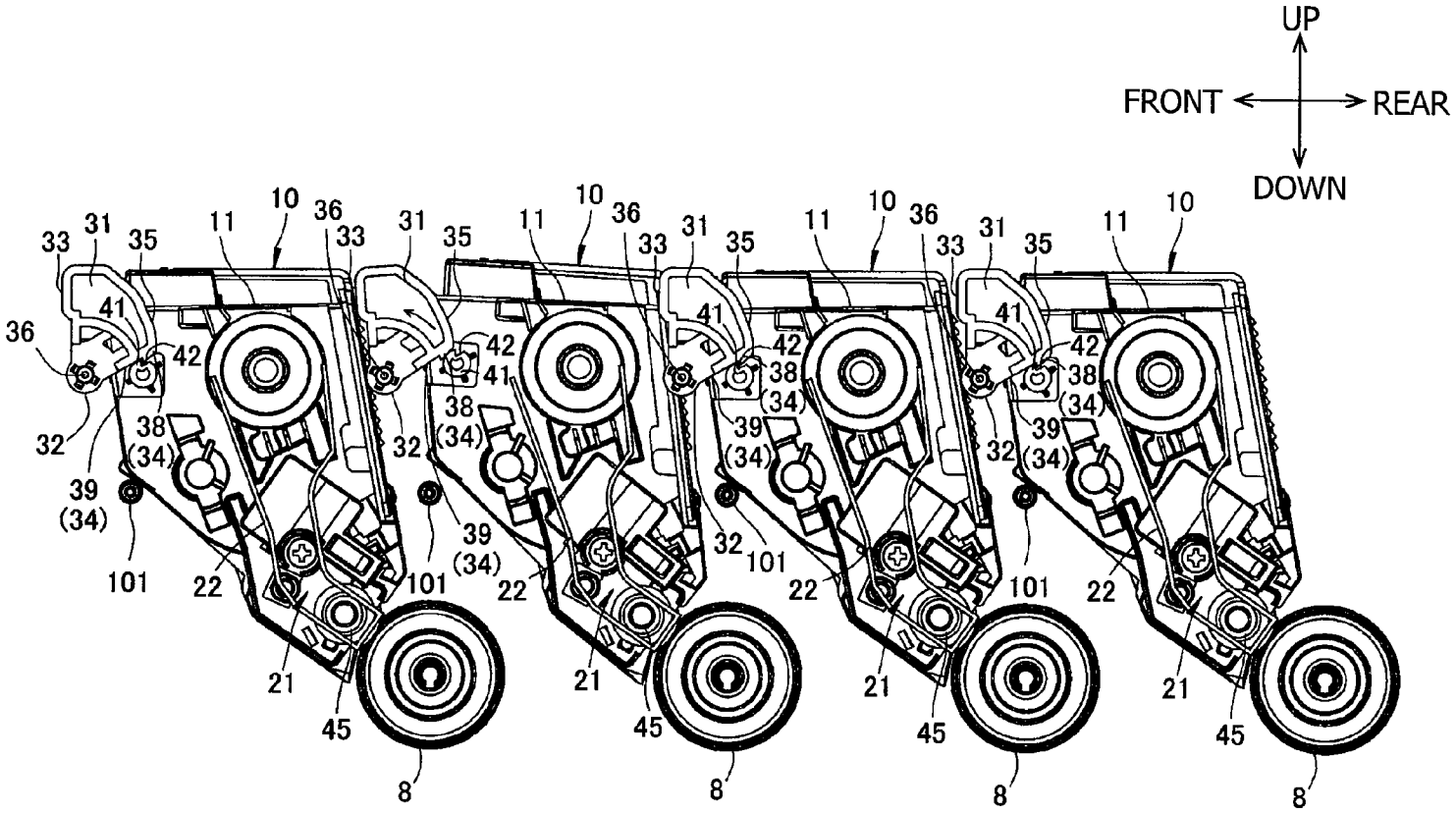
FIG. 3B is a right-side view of the drawer unit (in which the drawer frame is not shown) in the middle of the development cartridge being attached thereto in the embodiment according to one or more aspects of the present invention.

After that, an upper end of the development cartridge 10 is pushed forward. Thereby, the pressed boss 41 moves toward the linear surface 34 while sliding in contact with the protruding surface 35. Then, as depicted in FIG. 3B, the pressed boss 41 slides under the linear surface 34 from a position on the protruding surface 35 so as to push up the pressing member 31.

Figure 3C:
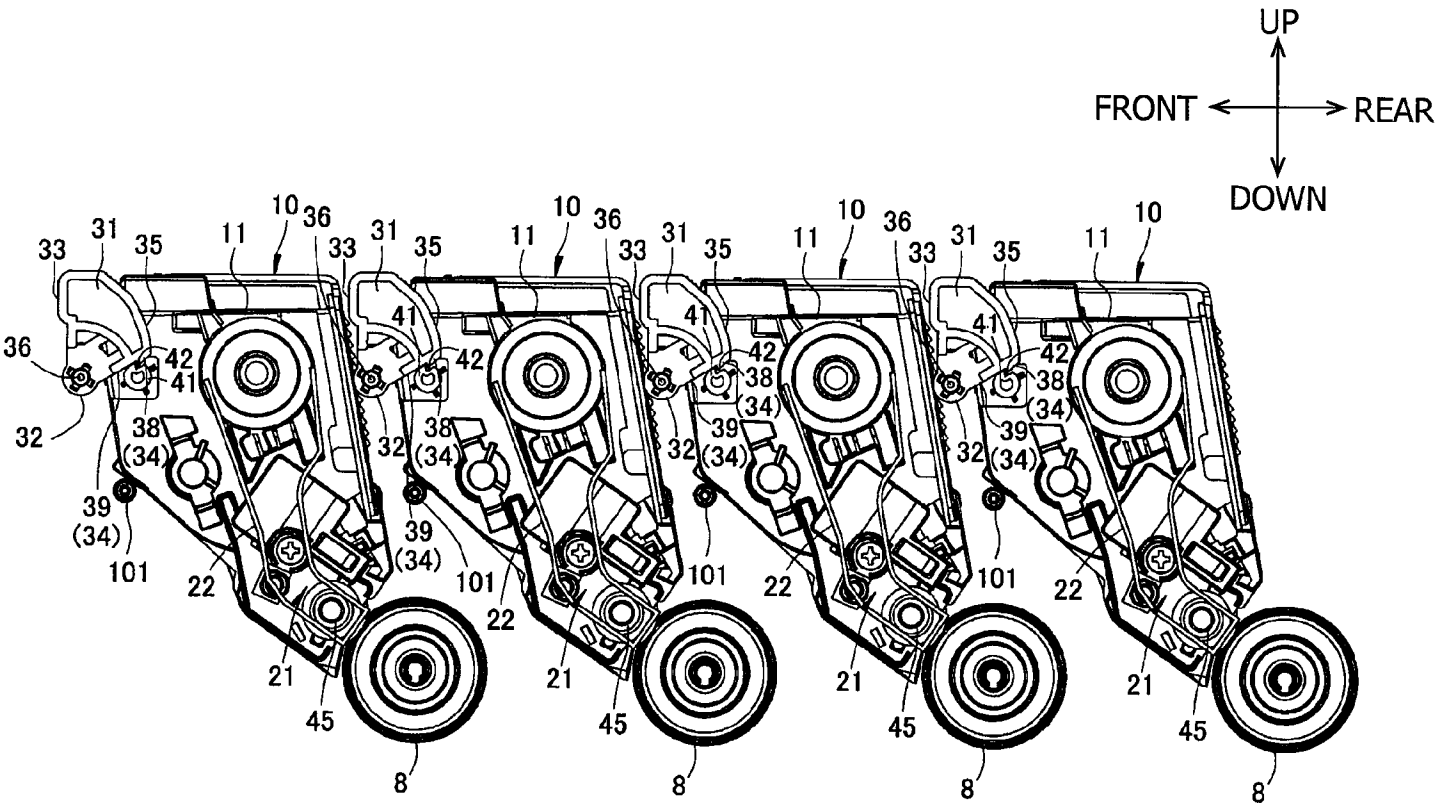
FIG. 3C is a right-side view of the drawer unit (in which the drawer frame is not shown) after the development cartridge is attached thereto in the embodiment according to one or more aspects of the present invention.

Further, the pressed boss 41 moves toward the half-arc surface 32 while sliding in contact with the linear surface 34, and gets over the restriction section 38. Then, as shown in FIG. 3C, the pressed boss 41 moves to such a position as to be slightly away from the restriction section 38. Thereafter, when the development housing 11 comes into contact with a supporting portion 101 of the drawer frame 5 from a rear side so as to restrict a further tilting movement of the development cartridge 10, the attachment of the development cartridge 10 to the drawer frame 5 is completed. In this state, the pressing section 39 of the pressing member 31 contacts the pressed boss 41 from an upper front side, so as to urge the pressed boss 41 in a direction substantially parallel to a direction in which the photoconductive drum 8 presses the development roller 12.

After the development cartridge 10 is attached to the drawer frame 5, the drawer frame 5 is moved to the housed position inside the main body casing 2. At this time, when the drawer frame 5 is moved swiftly with a great force, a rearward force may be applied to an upper end of the development cartridge 10 due to an impact generated when the movement of the drawer frame 5 is stopped in the housed position.

Figure 3D:
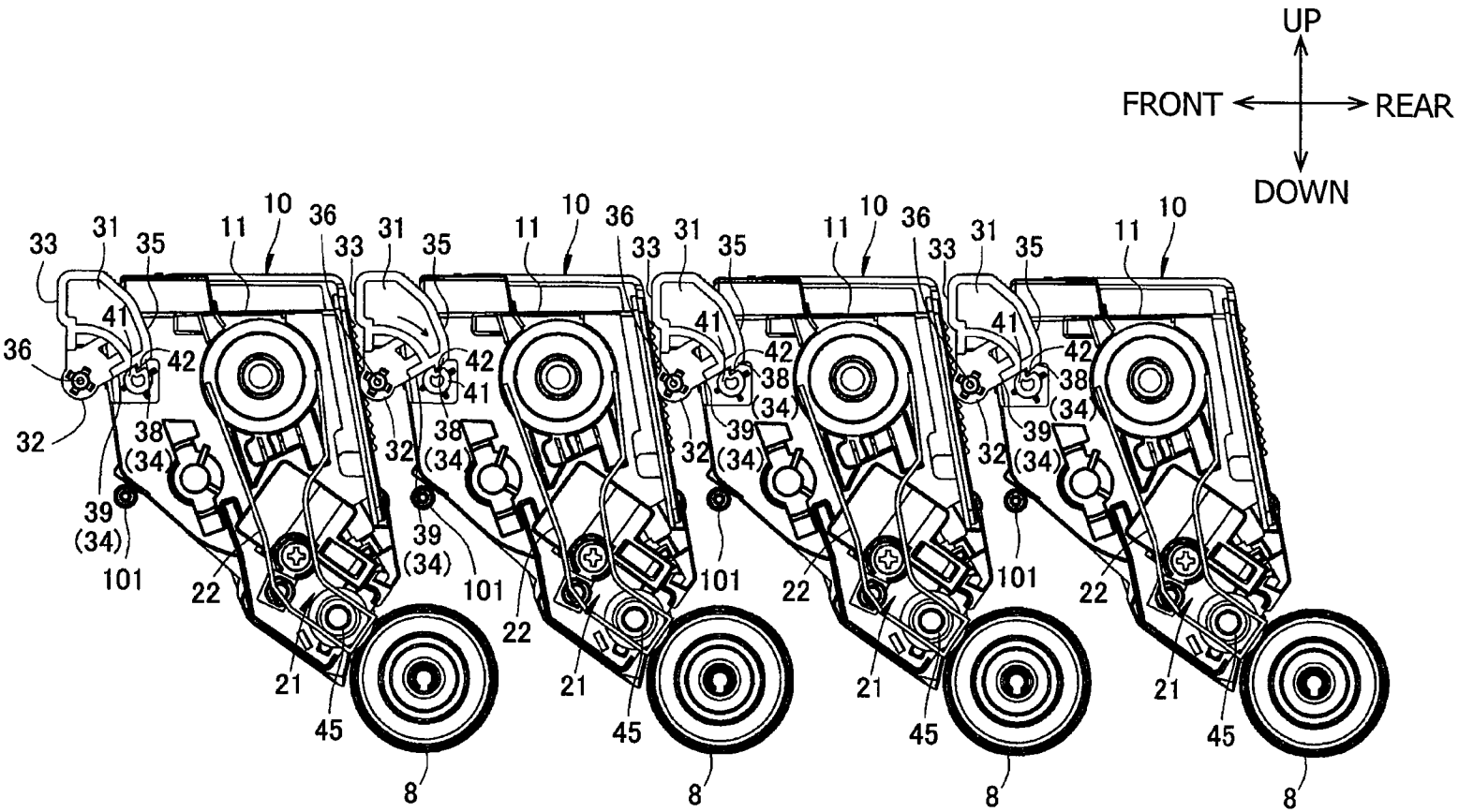
FIG. 3D is a right-side view of the drawer unit (in which the drawer frame is not shown) in a state where a pressed boss comes in contact with a restriction section in the embodiment according to one or more aspects of the present invention.

When such a force is applied to an upper end of the development cartridge 10, the development cartridge 10 is tilted rearward. Thereby, the pressed boss 41 moves toward the restriction section 38 while sliding in contact with the pressing section 39. When the pressed boss 41 moves to such a position as to contact the restriction section 38, the restriction section 38 gets into the notch 42 of the pressed boss 41, as shown in FIG. 3D. Then, the restriction section 38 contacts the first flat surface 42A of the pressed boss 41.

At this time, as illustrated in FIG. 4, a straight line L1 intersects a tangential line L2, so as to form an acute angle at a downstream side relative to the straight line L1 in the direction in which the pressing section 39 presses the pressed boss 41, when viewed from the right side. It is noted the straight line L1 is a line extending in a released direction that is a moving direction of the pressed boss 41 through a contact point between the restriction section 38 and the first flat surface 42A. Further, the tangential line L2 is a tangential line that touches both the restriction section 38 and the first flat surface 42A at the contact point. Additionally, the tangential line L2 intersects a straight line L3, so as to form an acute angle at a downstream side relative to the straight line L3 in the direction in which the pressing section 39 presses the pressed boss 41, when viewed from the right side. It is noted that the straight line L3 is a line passing through the center line of the shaft 36 and the contact point between the restriction section 38 and the first flat surface 42A.

Therefore, after contact is established between the restriction section 38 and the first flat surface 42A of the pressed boss 41, the force that the restriction section 38 receives from the pressed boss 41 is changed into a force in such a direction that the pressing section 39 presses the pressed boss 41, as indicated by an arrow in FIG. 3D. As a result, the movement of the pressed boss 41 in the released direction is restricted, such that the pressed boss 41 is prevented from getting over the restriction section 38 to be away from the linear surface 34.

Figure 3E:
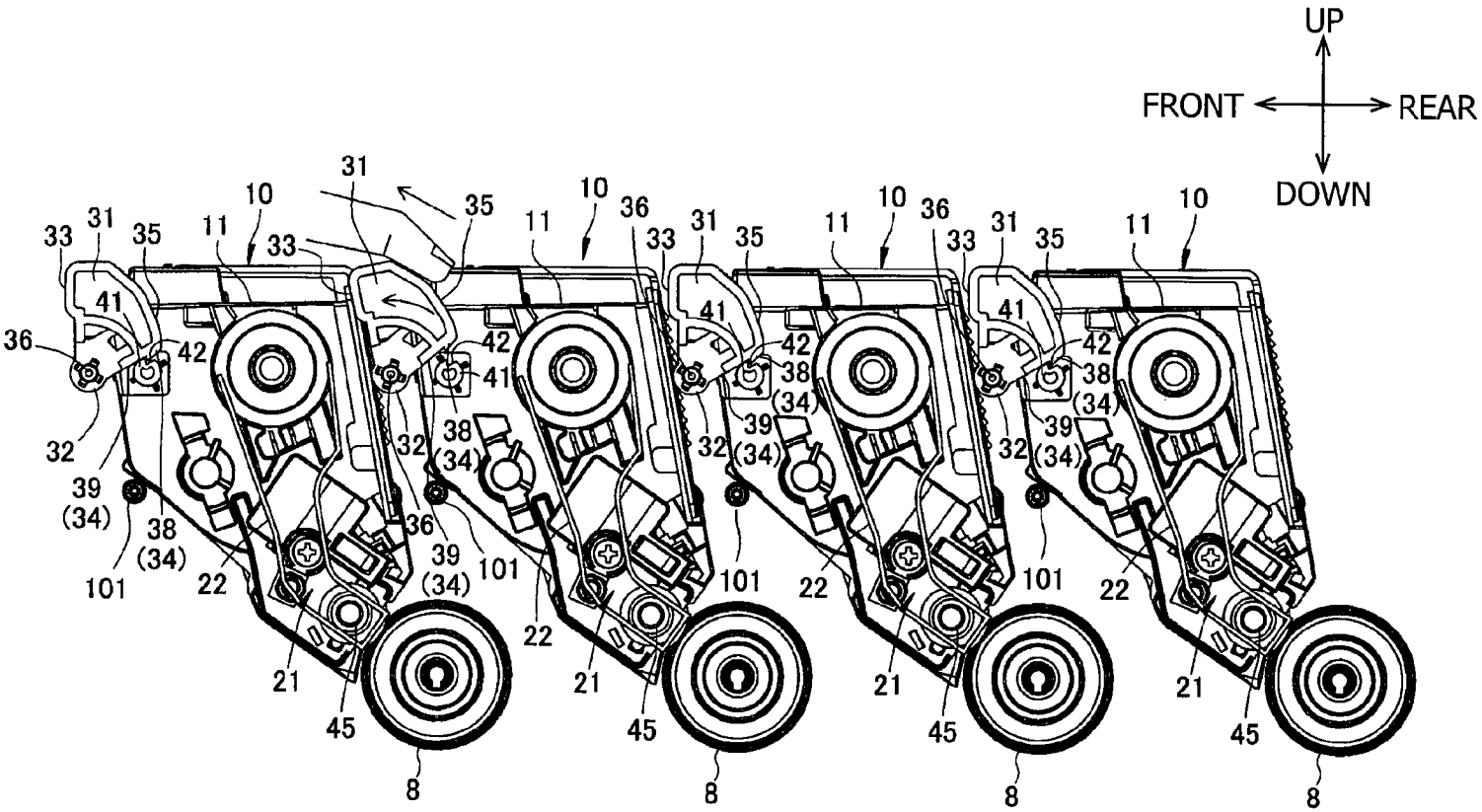
FIG. 3E is a right-side view of the drawer unit (in which the drawer frame is not shown) in a state where a pressing member is operated by a user's finger in the embodiment according to one or more aspects of the present invention.

When the development cartridge 10 is detached from the drawer frame 5, the drawer frame 5 (the drawer unit 3) is pulled out to the pulled position outside the main body casing 2. Then, as shown in FIG. 3E, when the pressing member 31 is turned forward by a user's finger against the clockwise urging force by the linear spring 37 when viewed from the right side, the pressing section 39 is separated from the pressed boss 41. At this time, the restriction section 38 is placed out of a path on which the pressed boss 41 moves in the released direction.

Figure 3F:
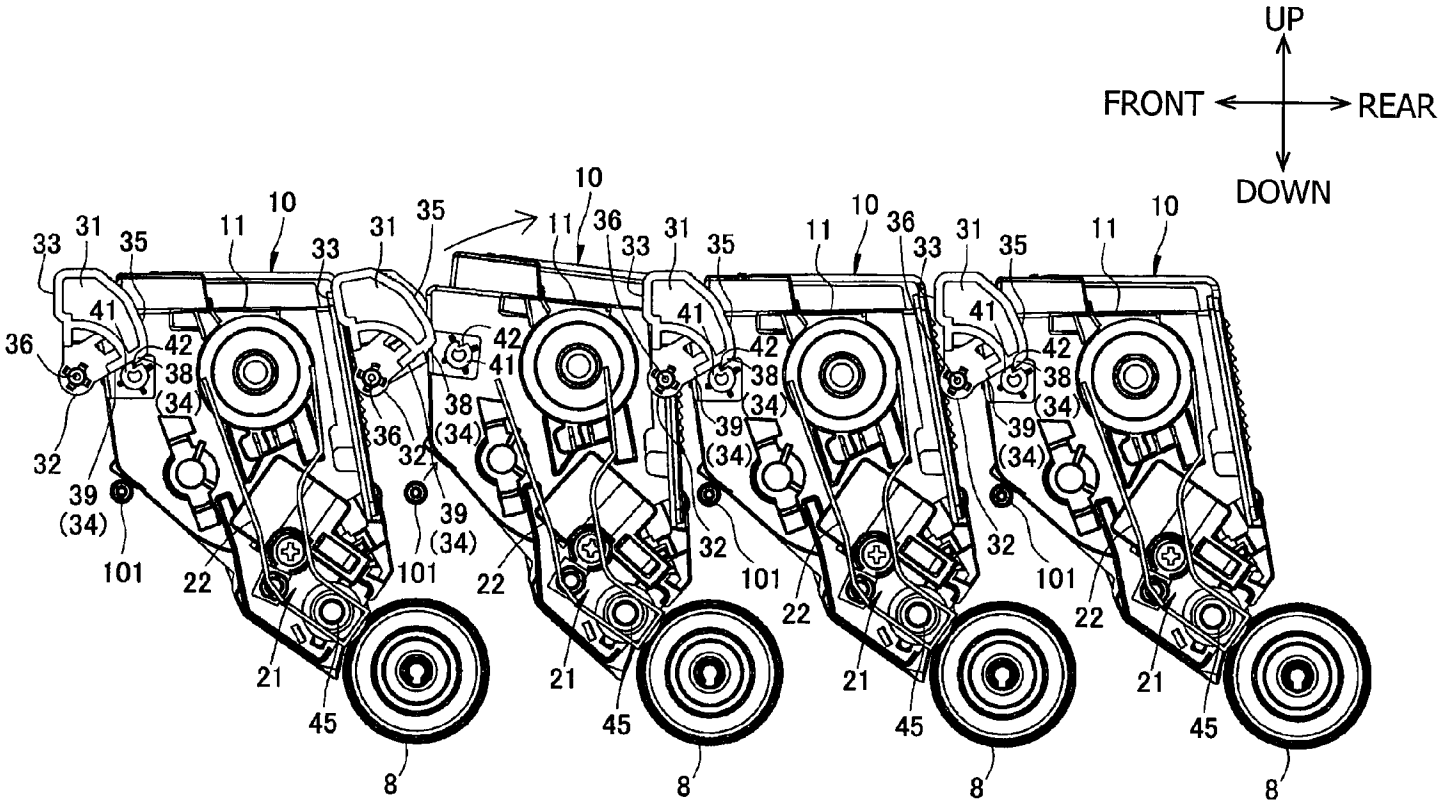
FIG. 3F is a right-side view of the drawer unit (in which the drawer frame is not shown) in a state where the development cartridge is in a released state (takes a released posture) in the embodiment according to one or more aspects of the present invention.
Figure 3G:
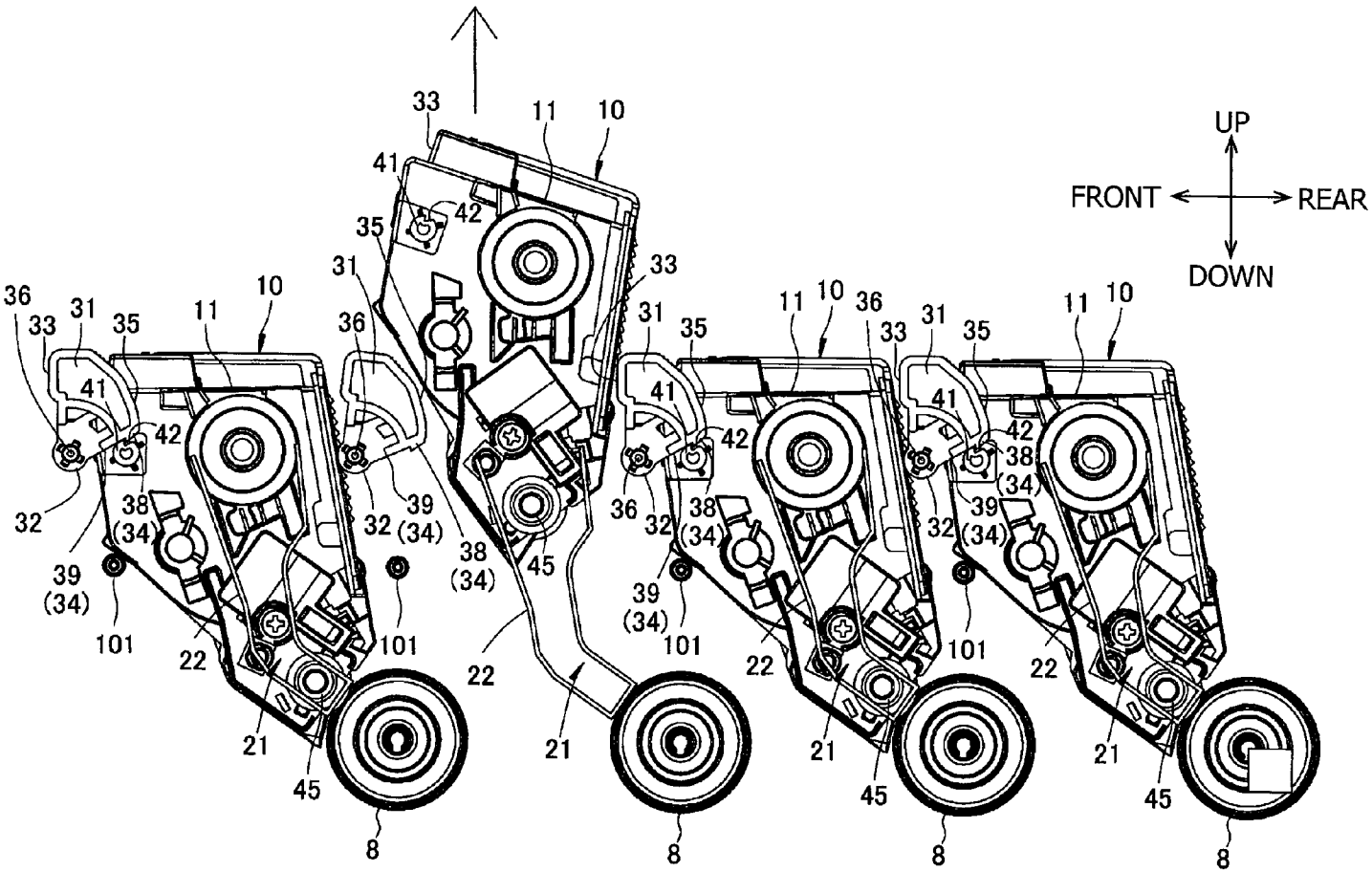
FIG. 3G is a right-side view of the drawer unit (in which the drawer frame is not shown) in a state where the development cartridge is lifted up in the embodiment according to one or more aspects of the present invention.

After that, an upper end of the development cartridge 10 is pushed rearward while keeping the posture of the pressing member 31. Thereby, as illustrated in FIG. 3F, when the pressed boss 41 is behind the pressing member, the development cartridge 10 is placed in a released state (takes a released posture). When the development cartridge 10 is in the released state, the development cartridge 10 is lifted up and completely detached from the drawer frame 5, as depicted in FIG. 3G.

5. Effects (1) Effect 1

As described above, the development cartridge 10 includes the pressed boss 41 and the development roller 12. Further, when attached to the drawer frame 5 that holds the photoconductive drum 8, the development cartridge 10 can move between a pressed posture (a pressed state) where the pressed boss 41 is pressed by the pressing member 31 and the released state where the pressed boss 41 is released from the pressing of the pressing member 31. The pressing member 31 is provided to the drawer frame 5 and provided with the pressing section 39 and restriction section 38. The pressing section 39 contacts and presses the pressed boss 41 when the development cartridge 10 is in the pressed state. The restriction section 38 is disposed in a different position from that of the pressing section 39 and configured to restrict the movement of the pressed boss 41 in the pressing state in the released direction of the pressed boss 41 (i.e., the moving direction in which the pressed boss 41 moves when the development cartridge 10 moves from the pressing state to the released state).

As the restriction section 38 restricts the movement of the pressed boss 41 in the released direction, it is possible to prevent the development cartridge 10 from being improperly detached from the drawer frame 5. The restriction section 38 is provided not separately from but to the pressing member 31. Thus, with such a simple configuration it is possible to prevent the development cartridge 10 from being improperly detached from the drawer frame 5.

(2) Effect 2

The pressing section 39 and the restriction section 38 are arranged in the aforementioned order in the released direction. Namely, the pressing section 39 is disposed upstream relative to the restriction section 38 in the released direction. Therefore, it is possible to certainly restrict the movement of the pressed boss 41 (from the pressed state to the released state) in the released direction. Consequently, it is possible to prevent in a favorable manner the development cartridge 10 from being improperly detached from the drawer frame 5.

(3) Effect 3

In addition, when moves in the released direction, the pressed boss 41 comes in contact with the restriction section 38 such that the movement thereof is restricted. After contact is established between the pressed boss 41 and the restriction section 38, the force that the restriction section 38 receives from the pressed boss 41 is changed into a pressing force in the pressing direction in which the pressing section 39 presses the pressed boss 41.

In the color printer 1, the straight line L1 (which extends in the released direction through the contact point between the restriction section 38 and the first flat surface 42A when contact is established therebetween) and the tangential line L2 (which touches both the restriction section 38 and the first flat surface 42A at the contact point) form an acute angle at a downstream side relative to the straight line L1 in the direction in which the pressing section 39 presses the pressed boss 41. Thereby, the force that the restriction section 38 receives from the pressed boss 41 is certainly changed into the pressing force after contact is established between the pressed boss 41 and the restriction section 38.

As a result, the force with which the pressing member 39 presses the pressed boss 41 rises, and thereby it is possible to more certainly restrict the movement of the pressed boss 41. Thus, it is possible to prevent in a more favorable manner the development cartridge 10 from being improperly detached from the drawer frame 5.

(4) Effect 4

The restriction section 38 is disposed in a position where the restriction section 38 can be separated from the pressed boss 41 when the development cartridge 10 is in the pressing state. Thereby, the restriction section 38 is generally separated from the pressed boss 41 when the development cartridge 10 is in the pressing state. Hence, since there is no risk that the restriction section 38 might exert any influence on the pressed boss 41, the pressing section 39 can press the pressed boss 41 in favorable manner.

(5) Effect 5

The pressed boss 41 includes its circumferential surface and the first flat surface 42A. The circumferential surface of the pressed boss 41 receives a force from the pressing section 39. The first flat surface 42A receives a force from the restriction section 38 after establishing a contact with the restriction section 38. The pressed boss 41 includes the notch 42 formed to be recessed in the opposite direction to the released direction. The first flat surface 42A faces the notch 42. In the pressed boss 41, the circumferential surface that receives a force from the pressing section 39 is different from the first flat surface 42A that receives a force from the restriction section 38. Thereby, it is possible to design the pressing section 39 and the restriction section 38 separately, and thus to design the pressing member 31 more flexibly.

(6) Effect 6

The pressing member 31 is rotatably supported by the shaft 36 provided to the drawer frame 5, and urged against the development cartridge 10 by the linear spring 37 (see FIG. 2). With such a simple configuration, it is possible to allow the pressing section 39 of the pressing member 31 to press the pressed boss 41.

(7) Effect 7

When the pressed boss 41 contacts the restriction section 38 at the contact point, the tangential line L2 (which touches both the restriction section 38 and the first flat surface 42A at the contact point) and the straight line L3 (which passes through the center line of the shaft 36 and the contact point) form an acute angle at a downstream side relative to the straight line L3 in the direction in which the pressing section 39 presses the pressed boss 41 when viewed from the right side. Thereby, it is possible to prevent the pressing member 31 from turning in such a direction that the pressing section 39 is farther from pressed boss 41 when the pressed boss 41 contacts the restriction section 38. Thus, it is possible to restrict the movement of the pressed boss 41 by the restriction section 38 in a more favorable manner.

(8) Effect 8

The pressing member 31 includes the protruding surface 35. The protruding surface 35 serves as a guide surface for guiding the pressed boss 41, which is in non-contact with the pressing section 39, to such a position as to contact the pressing section 39. Accordingly, when the development cartridge 10 is attached to the drawer frame 5, it is possible to guide the pressed boss 41 by the protruding surface 35 into the position to contact the pressing section 39. Therefore, it is possible to easily place the pressed boss 41 into the position to contact the pressing section 39.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

6. Modifications (1) First Modification

Figure 5:
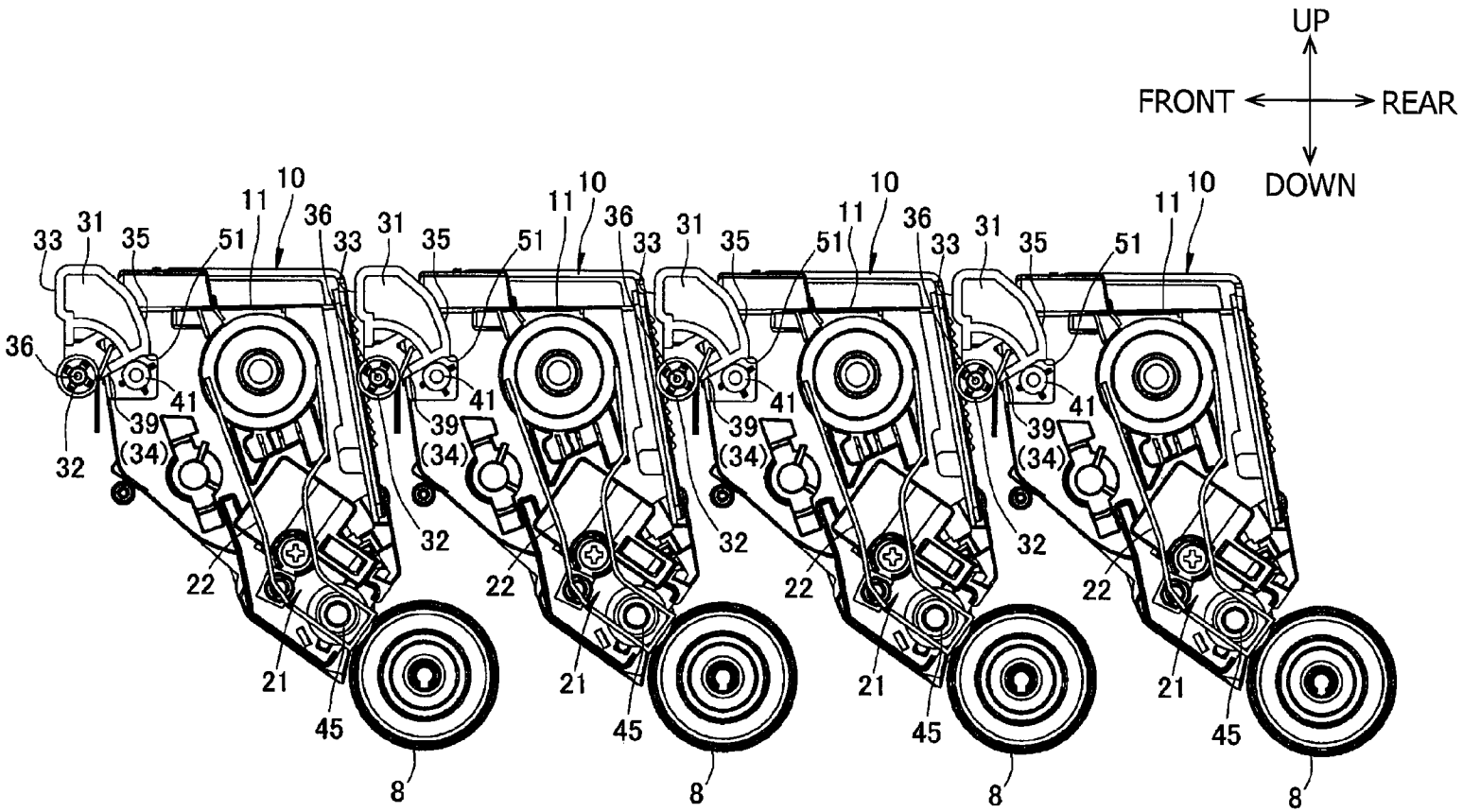
FIG. 5 is a right-side view of a drawer unit including a pressing member and a pressed boss in a first modification according to one or more aspects of the present invention.

Instead of the restriction section 38 provided to the pressing section 31 as shown in FIG. 4, for instance, as illustrated in FIG. 5, a restriction section 51 that is a projection smaller than the restriction section 38 may be formed at an end, closer to the protruding surface 35, of the linear surface 34. Further, as illustrated in FIG. 5, the pressed boss 41 may not necessarily formed with the notch 42.

Figure 6:
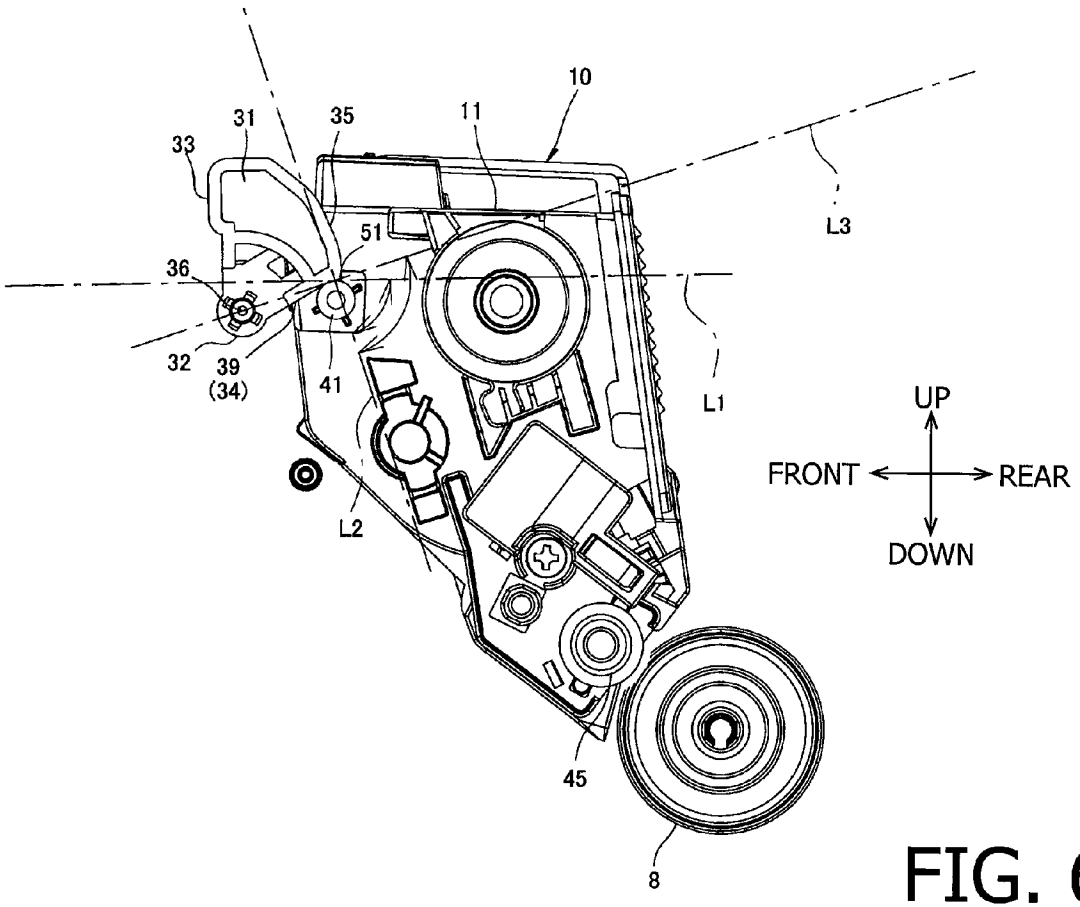
FIG. 6 is a right-side view illustrating in an enlarged manner a part of the drawer unit shown in FIG. 5 in a state where the pressed boss contacts a restriction section in the first modification according to one or more aspects of the present invention.

When a rearward force is applied to an upper end of the development cartridge 10 after the development cartridge 10 is attached to the drum frame 5, the pressed boss 41 moves toward the restriction section 51 while sliding in contact with the pressing section 39. When the pressed boss 41 moves to a contact position where it contacts the restriction section 51, the pressed boss 41 contacts the restriction section 51 as shown in FIG. 6. At this time, a straight line L1 (which extends in a released direction that is a moving direction of the pressed boss 41 through a contact point between the restriction section 51 and the pressed boss 41) intersects a tangential line L2 (which touches both the restriction section 51 and the pressed boss 41 at the contact point) so as to form an acute angle at a downstream side relative to the straight line L1 in a direction in which the pressing section 39 presses the pressed boss 41, when viewed from the right side. Further, the tangential line L2 intersects a straight line L3 (which passes through the center line of the shaft 36 and the contact point between the restriction section 51 and the pressed boss 41) so as to form an acute angle at a downstream side relative to the straight line L3 in the direction in which the pressing section 39 presses the pressed boss 41, when viewed from the right side.

Therefore, the force that the restriction section 51 receives from the pressed boss 41 after contact is established between the restriction section 51 and the pressed boss 41 is changed into a force in a direction in which the pressing section 39 presses the pressed boss 41. Consequently, the movement of the pressed boss 41 in the released direction is restricted, such that the pressed boss 41 is prevented from getting over the restriction section 51 to be away from the linear surface 34.

(2) Second Modification

Figure 7:
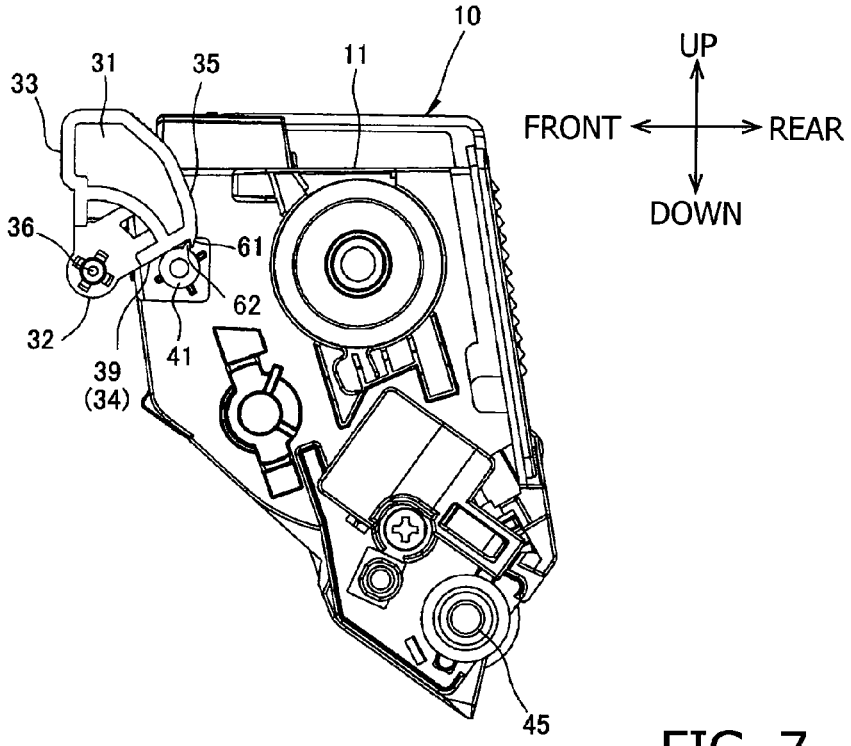
FIG. 7 is a right-side view of a development cartridge including a pressing member and a pressed boss in a second modification according to one or more aspects of the present invention.

Additionally, as illustrated in FIG. 7, an unguiform restriction section 61 may be formed at an end, closer to the protruding surface 35, of the linear surface 34. The restriction section 61 has a forward-facing surface that forms an acute angle with the pressing section 39 (the linear surface 34) and is smaller than the restriction section 38 shown in FIG. 4.

In this case, a projection 62 may be formed on the circumferential surface of the pressed boss 41. When the pressed boss 41 moves rearward, the projection 62 may contact a corner formed between the pressing section 39 and the restriction section 61. Thereby, the pressing member 31 is turned clockwise by a force that the restriction section 61 receives from the projection 62 after contact is established between the projection 62 and the corner, when viewed from the right side. Consequently, a force in a direction in which the pressing section 39 presses the pressed boss 41 rises.

Thus, the drawer unit 3 configured as above in the second modification can provide the same effects as those described in the aforementioned embodiment and the first modification.

(3) Third Modification

Figure 8:
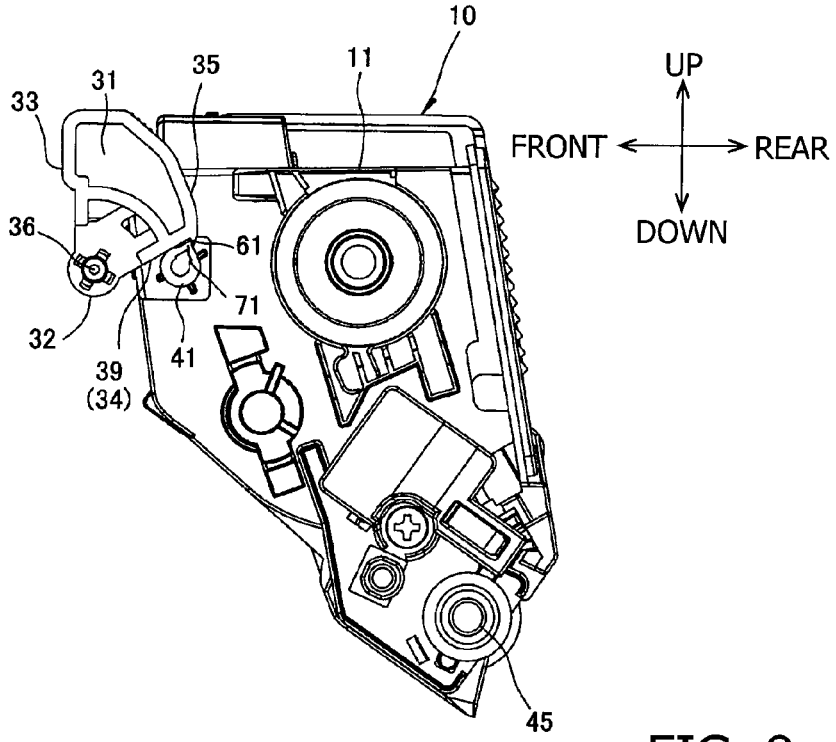
FIG. 8 is a right-side view of a development cartridge including a pressing member and a pressed boss in a third modification according to one or more aspects of the present invention.

Additionally, when the pressing member 31 is formed with the restriction section 61, the pressed boss 41 may be formed in a teardrop shape with a pointed projection 71 when viewed in the left-to-right direction, as shown in FIG. 8. In this case, when the pressed boss 41 moves rearward, the projection 71 may contact the corner formed between the pressing section 39 and the restriction section 61.

Thus, the drawer unit 3 configured as above in the second modification can provide the same effects as those described in the second modification in which the pressed boss 41 is formed with the projection 62 (see FIG. 7).

(4) Fourth Modification

Figure 9:
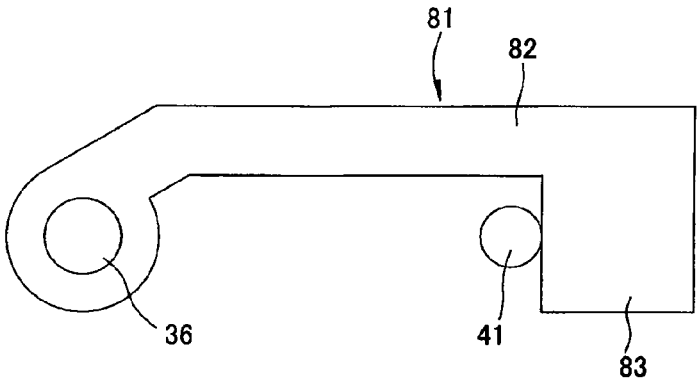
FIG. 9 is a right-side view showing a pressing member and a pressed boss in a fourth modification according to one or more aspects of the present invention.

Instead of the pressing member 31 formed substantially in a fan shape when viewed in the left-to-right direction, a pressing member 81 shaped as shown in FIG. 9 may be employed. The pressing member 81 may be formed as an arm extending rearward from the shaft 36. Specifically, the pressing member 81 may be formed integrally with a pressing section 82 (which has a base end supported rotatably by the shaft 36, slightly extends toward an upper rear side, and then bends and extends rearward) and a restriction section 83 (which is formed in a rectangle shape when viewed in the left-to-right direction). The shaft 36 and the pressed boss 41 face each other in the front-to-rear direction. Further, a forward-facing surface of the restriction section 83 extends substantially in the up-to-down direction (the vertical direction) in a state where the pressing section 82 presses the pressed boss 41.

According to this configuration, when the pressed boss 41 moves rearward, the pressed boss 41 comes in contact with the restriction section 83. Consequently, the movement of the pressed boss 41 is restricted. At this time, the pressed boss 41 does not provide the restriction section 83 with any force for turning the pressing member 81. Thus, it is possible to prevent the development cartridge 10 from being improperly detached from the drawer frame 5.

(5) Fifth Modification

Figure 10:
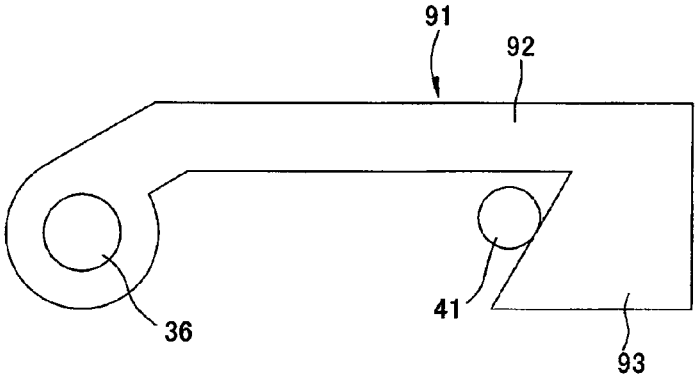
FIG. 10 is a right-side view showing a pressing member and a pressed boss in a fifth modification according to one or more aspects of the present invention.

Instead of the pressing member 31 formed substantially in a fan shape when viewed in the left-to-right direction, a pressing member 91 shaped as shown in FIG. 10 may be employed. The pressing member 91 may be formed as an arm extending rearward from the shaft 36. Specifically, the pressing member 91 may be formed integrally with a pressing section 92 (which has a base end supported rotatably by the shaft 36, slightly extends toward an upper rear side, and then bends and extends rearward) and a restriction section 93 (which is formed in a trapezoidal shape when viewed in the left-to-right direction). The shaft 36 and the pressed boss 41 face each other in the front-to-rear direction. Further, a forward-facing surface of the restriction section 93 is tilted rearward with respect to the vertical direction, in a state where the pressing section 92 presses the pressed boss 41.

According to this configuration, when the pressed boss 41 moves rearward, the pressed boss 41 comes in contact with the restriction section 93. Consequently, the movement of the pressed boss 41 is restricted. At this time, the pressed boss 41 provides the restriction section 93 with a force directed toward a lower rear side. Accordingly, the pressing member 91 is turned clockwise when viewed from the right side. Consequently, a force in a direction in which the pressing section 92 presses the pressed boss 41 rises. Thus, it is possible to certainly prevent the development cartridge 10 from being improperly detached from the drawer frame 5.

In the aforementioned embodiment, the pressing section 39 is provided to the drawer frame 5 that includes a plurality of development cartridges 10 detachably attached thereto. However, such an aspect of the present invention may be applied to a monochrome-type drum cartridge.

What is claimed is:

1. A drum unit comprising:

a frame;

a development cartridge configured to be detachably attached to the frame, wherein the development cartridge comprises:

a pressed portion formed substantially in a cylindrical boss shape having a cylindrical surface; and a developer holding body configured to hold and carry thereon development agent;

a photoconductive body held by the frame, the photoconductive body having a surface configured to be supplied with the development agent from the developer holding body; and a pressing member provided to the frame, wherein the frame is configured such that the development cartridge is movable relative to the frame between a pressed state where the pressed portion is pressed by the pressing member when the development cartridge is attached to the frame and a released state where the pressed portion is released from pressing of the pressing member when the development cartridge is attached to the frame, wherein the pressing member comprises:

a pressing section configured to contact and press the pressed portion when the development cartridge is in the pressed state;

a guide section configured to guide the pressed portion to a position where the pressed portion comes into contact with the pressing section while letting the cylindrical surface of the pressed portion slide in contact with the guide section, when the development cartridge is attached to the frame; and a restriction section that is disposed in a different position from a position of the pressing section and configured to restrict movement of the pressed portion in a released direction when the development cartridge is in the pressed state, the released direction being a direction in which the pressed portion moves when the development cartridge moves from the pressed state to the released state, and wherein the pressed portion comprises at least one of:

a notch recessed in a radial direction of the pressed portion; and a projection protruding in the radial direction of the pressed portion.

2. The drum unit according to claim 1, wherein the pressing section and the restriction section are arranged along the released direction.

3. The drum unit according to claim 1, wherein the restriction section is configured to change a force received from the pressed portion after the pressed portion moves in the released direction and contacts the restriction section, into a force in a pressing direction in which the pressing section presses the pressed portion.

4. The drum unit according to claim 3, wherein the restriction section is configured such that when the pressed portion contacts the restriction section at a contact point, a straight line extending in the released direction through the contact point intersects a tangential line touching the restriction section and the pressed portion at the contact point, so as to form an acute angle at a downstream side relative to the straight line in the pressing direction.

5. The drum unit according to claim 1, wherein the restriction section is disposed in a position where the restriction section is able to be separated from the pressed portion when the development cartridge is in the pressing state.

6. The drum unit according to claim 1, wherein the pressed portion comprises:

a first pressed section configured to be pressed by the pressing section; and a second pressed section configured to, after contacting the restriction section, be pressed by the restriction section.

7. The drum unit according to claim 6, wherein the pressed portion comprises the notch recessed in a direction opposite to the released direction, and wherein the second pressed section faces the notch.

8. The drum unit according to claim 1, further comprising:

a shaft that is provided to the frame and supports the pressing member rotatably; and an urging member configured to urge the pressing member toward the development cartridge.

9. The drum unit according to claim 8, wherein the pressing member is configured such that when the pressed portion contacts the restriction section at a contact point, a straight line passing through a center line of the shaft and the contact point intersects a tangential line touching the restriction section and the pressed portion at the contact point, so as to form an acute angle at a downstream side relative to the straight line in a pressing direction in which the pressing section presses the pressed portion.

10. The drum unit according to claim 1, wherein the pressed portion comprises the notch recessed in the radial direction of the pressed portion.

11. The drum unit according to claim 1, wherein the pressed portion comprises the projection protruding in the radial direction of the pressed portion.

12. An image forming apparatus comprising:

a main body casing;

a process unit;

a drum unit attached into the main body casing to be movable between a first position where the process unit is inside the main body casing and a second position where the process unit is outside the main body casing, the drum unit comprising:

a frame;

a photoconductive body held by the frame; and a pressing member provided to the frame; and a development cartridge detachably attached to the frame of the drum unit, the development cartridge comprising:

a pressed portion formed substantially in a cylindrical boss shape having a cylindrical surface; and a developer holding body configured to hold and carry thereon development agent to be supplied to a surface of the photoconductive body, wherein the development cartridge is movable between a pressed state where the pressed portion is pressed by the pressing member when the development cartridge is attached to the frame and a released state where the pressed portion is released from pressing of the pressing member when the development cartridge is attached to the frame, wherein the pressing member comprises:

a pressing section configured to contact and press the pressed portion when the development cartridge is in the pressed state;

a guide section configured to guide the pressed portion to a position where the pressed portion comes into contact with the pressing section while letting the cylindrical surface of the pressed portion slide in contact with the guide section, when the development cartridge is attached to the frame; and a restriction section that is disposed in a different position from a position of the pressing section and configured to restrict movement of the pressed portion in a released direction when the development cartridge is in the pressed state, the released direction being a direction in which the pressed portion moves when the development cartridge moves from the pressed state to the released state, and wherein the pressed portion comprises at least one of:

a notch recessed in a radial direction of the pressed portion; and a projection protruding in the radial direction of the pressed portion.

13. The image forming apparatus according to claim 12, wherein the pressing section and the restriction section are arranged along the released direction.

14. The image forming apparatus according to claim 12, wherein the restriction section is configured to change a force received from the pressed portion after the pressed portion moves in the released direction and contacts the restriction section, into a force in a pressing direction in which the pressing section presses the pressed portion.

15. The image forming apparatus according to claim 14, wherein the restriction section is configured such that when the pressed portion contacts the restriction section at a contact point, a straight line extending in the released direction through the contact point intersects a tangential line touching the restriction section and the pressed portion at the contact point, so as to form an acute angle at a downstream side relative to the straight line in the pressing direction.

16. The image forming apparatus according to claim 12, wherein the restriction section is disposed in a position where the restriction section is able to be separated from the pressed portion when the development cartridge is in the pressing state.

17. The image forming apparatus according to claim 12, wherein the process unit further comprises:

a shaft that is provided to the frame and supports the pressing member rotatably; and an urging member configured to urge the pressing member toward the development cartridge.

18. The image forming apparatus according to claim 17, wherein the pressing member is configured such that when the pressed portion contacts the restriction section at a contact point, a straight line passing through a center line of the shaft and the contact point intersects a tangential line touching the restriction section and the pressed portion at the contact point, so as to form an acute angle at a downstream side relative to the straight line in a pressing direction in which the pressing section presses the pressed portion.

19. The image forming apparatus according to claim 12, wherein the pressed portion comprises the notch recessed in the radial direction of the pressed portion.

20. The image forming apparatus according to claim 12, wherein the pressed portion comprises the projection protruding in the radial direction of the pressed portion.

21. A development cartridge comprising:

a pressed portion formed substantially in a cylindrical boss shape having a cylindrical surface; and a developer holding body configured to hold and carry thereon development agent, wherein the development cartridge is detachably attachable to a frame of a drum unit, the drum unit comprising:

a photoconductive body held by the frame, the photoconductive body having a surface configured to be supplied with development agent from the developer holding body; and a pressing member provided to the frame, wherein the development cartridge is movable relative to the frame between a pressed state where the pressed portion is pressed by the pressing member when the development cartridge is attached to the frame and a released state where the pressed portion is released from pressing of the pressing member when the development cartridge is attached to the frame, wherein the pressing member comprises:

a pressing section configured to contact and press the pressed portion when the development cartridge is in the pressed state;

a guide section configured to guide the pressed portion to a position where the pressed portion comes into contact with the pressing section while letting the cylindrical surface of the pressed portion slide in contact with the guide section, when the development cartridge is attached to the frame; and a restriction section that is disposed in a different position from a position of the pressing section and configured to restrict movement of the pressed portion in a released direction when the development cartridge is in the pressed state, the released direction being a direction in which the pressed portion moves when the development cartridge moves from the pressed state to the released state, and wherein the pressed portion comprises:

a first pressed section configured to be pressed by the pressing section;

a second pressed section configured to, after contacting the restriction section, be pressed by the restriction section;and at least one of a notch recessed in a radial direction of the pressed portion and a projection protruding in the radial direction of the pressed portion.

22. The development cartridge according to claim 21, wherein the pressed portion comprises the notch recessed in a direction opposite to the released direction, and wherein the second pressed section faces the notch.

23. The development cartridge according to claim 21, wherein the pressed portion comprises the notch recessed in the radial direction of the pressed portion.

24. The development cartridge according to claim 21, wherein the pressed portion comprises the projection protruding in the radial direction of the pressed portion.

* * * * *